US009551095B2

(12) United States Patent
Lee

(10) Patent No.: US 9,551,095 B2
(45) Date of Patent: Jan. 24, 2017

(54) MODIFIED JERSEY KNIT FABRIC AND METHODS OF MAKING THE SAME

(71) Applicant: David E. Lee, New York, NY (US)

(72) Inventor: David E. Lee, New York, NY (US)

( * ) Notice: Subject to any disclaimer, the term of this patent is extended or adjusted under 35 U.S.C. 154(b) by 753 days.

(21) Appl. No.: 13/901,042

(22) Filed: May 23, 2013

(65) Prior Publication Data

US 2013/0295812 A1 Nov. 7, 2013

Related U.S. Application Data

(63) Continuation-in-part of application No. PCT/US2012/039423, filed on May 24, 2012.

(60) Provisional application No. 61/489,317, filed on May 24, 2011, provisional application No. 61/730,606, filed on Nov. 28, 2012.

(51) Int. Cl.

| | |
|---|---|
| ***D04B 7/16*** | (2006.01) |
| ***D04B 1/18*** | (2006.01) |
| ***D04B 1/22*** | (2006.01) |
| ***D04B 15/36*** | (2006.01) |

(52) U.S. Cl.

CPC . *D04B 1/18* (2013.01); *D04B 1/22* (2013.01); *D04B 7/16* (2013.01); *D04B 15/367* (2013.01); *Y10T 442/413* (2015.04); *Y10T 442/488* (2015.04)

(58) Field of Classification Search

CPC ..... D04B 1/18; D04B 1/22; D04B 7/16; D04B 15/367; Y10T 442/413; Y10T 442/488

See application file for complete search history.

(56) References Cited

U.S. PATENT DOCUMENTS

| | | | | |
|---|---|---|---|---|
| 2,503,444 A * | 4/1950 | Lawson | D04B 1/18 | 66/172 E |
| 2,653,463 A * | 9/1953 | Crimmins | D04B 1/18 | 66/190 |
| 3,729,956 A * | 5/1973 | Nebel | A41B 11/04 | 66/172 E |
| 3,733,859 A * | 5/1973 | Wittmann | D04B 21/18 | 66/193 |

(Continued)

FOREIGN PATENT DOCUMENTS

| | | |
|---|---|---|
| RU | 2160800 C1 | 12/2000 |
| SU | 943349 A1 | 7/1982 |
| SU | 1675434 A1 | 9/1991 |

OTHER PUBLICATIONS

PCT/US2012/039423 International Search Report and Written Opinion of the International Searching Authority.

*Primary Examiner* — Danny Worrell
(74) *Attorney, Agent, or Firm* — Moore & Hansen, PLLC; Robert C. Freed

(57) ABSTRACT

A knit fabric having a modified knit structure comprising a first layer of jersey knit fabric and a second layer of jersey knit fabric, wherein the first and second layers of jersey knit fabric are joined to each other by a third layer of tuck stitches, and wherein the first and second jersey stitch layers include at least one continuous strand of bare rubber and a plurality of continuous strands selected from the group consisting of continuous strands of bare rubber and continuous strands of non-elastic yarn, and the third layer of tuck stitches are made of continuous strands of non-elastic yarn, knit together into the fabric so as to hold the first and second jersey stitch layers together.

25 Claims, 7 Drawing Sheets

(56) References Cited

U.S. PATENT DOCUMENTS 5,284,031 A * 2/1994 Stoll ..... D04B 1/22 66/196
5,312,667 A * 5/1994 Lumb ..... D04B 1/24 428/91
5,385,036 A * 1/1995 Spillane ..... A43B 1/04 2/16
5,528,910 A * 6/1996 Azais ..... D04B 1/14 66/197
5,651,847 A * 7/1997 Loeffler ..... D04B 1/16 29/91.1
5,735,145 A * 4/1998 Pernick ..... D04B 1/16 604/378
5,783,277 A * 7/1998 Rock ..... B32B 5/26 2/258
5,817,391 A * 10/1998 Rock ..... A47C 27/006 428/309.9
5,896,758 A * 4/1999 Rock ..... A43B 1/04 66/191
6,156,406 A * 12/2000 Rock ..... B32B 5/12 428/86
6,644,070 B2 * 11/2003 Ikenaga ..... D04B 21/16 442/318
6,755,052 B1 * 6/2004 Sytz ..... D04B 1/18 66/19
6,779,369 B2 * 8/2004 Shepherd ..... D04B 1/126 66/193
7,360,378 B2 * 4/2008 Foshee ..... D04B 1/14 66/196
7,380,420 B1 * 6/2008 Liu ..... D04B 21/18 66/195
7,380,421 B1 * 6/2008 Liu ..... D04B 21/14 66/192
7,552,604 B1 * 6/2009 Waldrop ..... D04B 21/18 66/192
7,611,999 B2 * 11/2009 McMurray ..... D04B 1/102 442/304
7,849,715 B2 * 12/2010 Starbuck ..... A41C 3/0014 66/171
7,867,057 B2 * 1/2011 Scheininger ..... A41C 3/12 450/74
2003/0106346 A1 * 6/2003 Matsumoto ..... D04B 21/10 66/195
2004/0168479 A1 * 9/2004 McMurray ..... D02G 3/326 66/202
2013/0295812 A1 * 11/2013 Lee ..... D04B 1/18 442/306

* cited by examiner

MODIFIED JERSEY KNIT FABRIC AND METHODS OF MAKING THE SAME

RELATED APPLICATIONS

The present application is a continuation-in-part of PCT application number PCT/US2012/039423 filed May 24, 2012, which claims priority to U.S. Provisional Application No. 61/489,317, filed May 24, 2011; the present application also claims benefit under 35 U.S.C. 119(e) of U.S. Provisional Application No. 61/730,606, filed Nov. 28, 2012, the disclosures of which are hereby incorporated herein by reference.

TECHNICAL FIELD

The present invention relates generally to weft knit textile fabric and methods of making the same on computerized flatbed knitting machines, and, more particularly, to a modified weft knit textile fabric that has jersey stitch on the front and back made at least in part with strands of bare rubber, joined together by a ribbed tuck stitch structure. It is believed the incorporation of the strands of bare rubber provide the fabric with a number of advantageous performance enhancing properties.

BACKGROUND OF THE INVENTION

The development of specialized performance fabrics has transformed the textile industry. The particular properties possessed by performance fabrics are often critical to the market success of the products in which the fabrics are incorporated. For example, in athletic wear, it is highly desirable for a single fabric to be light weight, breathable, and even water resistant. Alternatively, in an upholstered furniture application, durability, tactile comfort and aesthetics may be of primary importance. For textile applications such as incorporation into outdoor furniture, desirable fabrics are often resistant to UV light/radiation, water, and antimicrobial growth properties, such as bacterial growth and mold growth inhibition properties, and also provide some stretch for comfort and rigidity for durability.

Achieving any particular combination of desirable characteristics in a single performance fabric is the focus of much research and development in the textile industry. The development of synthetic and natural yarns have provided the industry with the ability to achieve many new fabrics with combinations of properties desirable for the apparel, athletic, and furnishings industries. Although the selection of yarns, both synthetic and natural, is seemingly infinite, each new yarn often presents its own limitations, which can add to the difficulty of making the desired fabric when it comes to using the new yarn in the commercial knitting or weaving processes. For that reason, selecting the proper yarn or yarns and developing the proper weaving process or knitting methods to achieve the desired complex combination of properties in a single fabric continues to be challenging.

SUMMARY OF THE INVENTION

The present inventor has endeavored to develop specialized performance fabrics such as cushioned athletic mats, in which the inventor desires to incorporate non-skid surfaces to provide enhanced traction on each side of the fabric, combined with cushioning, moisture wicking and non-retention and further antimicrobial properties, all of which are preferred. The recent growth of the yoga market has created opportunities for the development of new products that address these concerns. In responding to these market needs, the inventor has invented a knit fabric having a modified knit structure including a front side and a back side. The knit fabric includes a first tuck stitch component, a second jersey stitch component and a third jersey stitch component; wherein the second jersey stitch component is located on the front side and includes at least one continuous strand of bare rubber and a plurality of continuous strands selected from the group consisting of continuous strands of bare rubber and continuous strands of non-elastic yarn, knit together into a jersey stitch pattern residing on the front side; and the third jersey stitch component is located on the back side and includes a plurality of continuous strands selected from the group consisting of continuous strands of bare rubber and continuous strands of non-elastic yarn, knit together into a jersey stitch pattern residing on the back side; wherein the first tuck stitch component includes a plurality of continuous strands selected from the group consisting of continuous strands of bare rubber and continuous strands of non-elastic yarn, knit together into a tuck stitch pattern that engages a plurality of continuous strands of the second jersey stitch component and a plurality of continuous strands of the third jersey stitch component so as to hold the second and third jersey stitch components together. In preferred embodiments the non-elastic yarn is polypropylene yarn, preferably spun polypropylene yarn. The strands of bare rubber are preferably strands of bare rubber that are at least partially coated either with a moisture absorbing powder such as Talcum powder or a silicone containing lubricating agent, either of which will reduce the degree to which the strands of bare rubber will catch on parts of the knitting machine used to make the present knit fabrics or parts of feeding devices used to feed the bare rubber from spools of such at least partially coated strands of bare rubber to the knitting machine. The preferred fabric is developed by utilizing the combination of strands of bare rubber and polypropylene yarn, knit on computerized flatbed knitting machines, utilizing feeding devices arranged to separately feed the non-elastic yarn for the preferred tuck stitches and the at least partially coated strands of bare rubber to the knitting machine from a plurality of cones on which the at least partially coated strands of bare rubber are wound. The strands of bare rubber are separately wound onto cones from which strands will be fed through the feeding devices and then into the preferred flatbed knitting machine. In preferred embodiments, the strands of bare rubber are coated with and agent including either a moisture absorbing powder selected from a group consisting of Talcum powder and starch powder such as cornstarch, *zea mays* powder and the like or a silicone containing lubricating agent selected from those silicone lubricating agents that are well known in the art. The preferred knitting machine will have at least two knitting beds, a front and a back bed. In one aspect, the present invention provides a knit fabric having a modified knit structure, comprising a first layer of jersey knit fabric knit on the front bed and a second layer of jersey knit fabric knit on the back bed, wherein the first and second layers of jersey knit fabric are joined to each other by a third layer of tuck stitches in a rib structure that utilizes both beds, and wherein strands of bare rubber are preferably used to form the first and second layers of jersey knit fabric and non-elastic yarn, preferably polypropylene yarn, is used to form the third layer of tuck stitches. In a second aspect, the present invention provides a knit fabric having a modified knit structure, comprising a first layer of jersey knit fabric knit on the front bed and a second layer of jersey knit fabric knit on the back bed, wherein the first and second layers of jersey knit fabric are joined to each other by a third layer of tuck stitches in a rib structure that utilizes both beds, and wherein polypropylene yarn is used to form the first and second layers of jersey knit fabric and bare rubber yarn is used to form the third layer of tuck stitches. In a third aspect, the invention provides a method for forming a modified knit structure fabric on a double bed flatbed knitting machine comprising a front needle bed and a back needle bed, wherein the fabric comprises polypropylene yarn and bare rubber yarn, and the fabric further comprises five or more properties selected from the group consisting of superior stretch recovery, superior moisture passage, superior breathability, superior antimicrobial qualities, superior resistance to degradation due to extended exposure to heat and sun and UV radiation, superior cushioning, and superior non-skid surface qualities. In a preferred embodiment, a method is provided for making a knit fabric of the present invention containing strands of bare rubber will comprise the steps of a) forming one or more rows of jersey knit stitch on both the front and back beds of the knitting machine, wherein the number of rows of jersey knit stitch formed is the same on both the front and back beds, b) forming one or more rows of tuck stitches in a rib structure connecting the rows of jersey knit stitches formed on the front and back beds, and c) repeating steps a and b until the knit fabric is of the desired size. In a fourth aspect, the invention provides a method for forming a modified knit structure fabric on a double bed flatbed knitting machine comprising a front needle bed and a back needle bed, wherein the fabric preferably includes polypropylene yarn and strands of bare rubber, and the fabric further includes one or more properties selected from the group consisting of superior stretch recovery, superior moisture passage, superior breathability, superior antimicrobial qualities, superior resistance to degradation due to extended exposure to heat and sunlight and UV radiation, superior cushioning, and superior non-skid surface qualities. In preferred embodiments, the method comprises the steps of i) forming a single row of tuck stitches in a rib structure across both beds, ii) forming a single row of jersey knit stitch on the front bed and a single row of jersey knit stitch on the back bed, iii) forming a single row of tuck stitches in a rib structure formed across both beds, iv) forming a single row of jersey knit stitch formed on the front bed and a single row of jersey knit stitch on the back bed, and v) repeating steps i) through iv) until the knit fabric is of the desired size; wherein the jersey stitch is formed at least in part with uncovered strands of bare rubber, preferably strands of uncovered bare rubber that are at least partially coated with a water absorbing powder, and the tuck stitch is made with a non-elastic yarn, preferably spun polypropylene yarn.

The non-elastic (low resilience) yarn of the present invention can be made of either or both synthetic or natural polymeric materials. Preferred yarns are preferably antimicrobial and/or mildew resistant, non-absorbent with respect to moisture, will take a dye or other colorant that does not fade rapidly when exposed to sunlight or UV light, have very low elasticity or resilience. As used herein, "non-elastic yarn" means yarn that has a very low resilience and does not readily stretch, even though it does have some give and does in fact stretch to a very small degree. The non-elastic yarn of the present invention can be any known or as yet unknown yarn that will not break when placed under a significant tension, which will preferably have a tensile strength of at least about 10 megapascals (MPa), more preferably about 20 megapascals (MPa), and most preferably about 30 megapascals (MPa). In preferred embodiments, the non-elastic yarn will be made of a synthetic thermoplastic material, preferably polypropylene. In the most preferred embodiments the non-elastic material will be spun polypropylene, which does not absorb water and is therefore largely anti-microbial and mildew resistant, it is easily dyed, it is not easily stretched, and in adds "sponge" to any fabrics in which it is incorporated, so that the fabric will provide more cushion.

The bare rubber is preferably a single strand of continuous bare rubber, but it will be appreciated that it could be multiple strands of bare rubber that are passed through a single feeder so that as many as two or three or even more strands of bare rubber are fed together into the knitting machine by a single feeder. As used herein, the word "continuous" means a long strand that is suitably windable on a cone for use in the present knitting process, but it does not means that the strand is without a beginning or an end. In preferred embodiments, the bare rubber is natural rubber obtained from Piedmont Stretch, Inc. (Winston Salem, N.C. 27103). Synthetic rubber can also be used in alternate embodiments, however, only so long as it is non-absorbent and provides a non-skid surface that is generally associated with natural rubber. The most preferred strands of bare rubber are extruded, 38 gauge uncovered natural bare rubber. The preferred strands of bare rubber are strands or ribbons that come in a sheet of separately scored ribbons from Piedmont Stretch, Inc. that are scored so that they can be separated into individual ribbons or strands and then wound up onto cones for use during the knitting process. The scored sheets of bare rubber are preferably coated with industrial grade Talcum powder that is coated on the outer surfaces of the scored sheets of bare rubber in an amount the is equal to a weight of from about 0.5 to about 4.0, preferably from about 1.0 to about 3.0, more preferably from about 1.5 to about 2.5, most preferably about 2 percent or less than the weight of the rubber, In preferred embodiments, the scored strands or ribbons are separated and wound onto a plurality of cones for use in the knitting process and the bare rubber strands or ribbons can be further coated with such powder during the process of separating the strands or ribbons of bare rubber from an elongated multi-strand ribbon. The powder, such as talcum powder or talc and the like, is used to minimize or at least reduce the amount of catch on the surface of the bare rubber to minimize elongation of such strands that can otherwise occur when surfaces of the strands of bare rubber catch on various surfaces of the knitting machine and the respective feeding devices used to feed the coated bare rubber strands to the knitting machine from cones of such wound, coated bare rubber. Such further processing preferably includes running the coated strand of bare rubber through a container containing such powder, although other methods of adding further powder the respective strands of bare rubber may also be used, prior to winding the strands of bare rubber onto such cones to further coat the strands of bare rubber to minimize the elongation that can occur during the knitting process In alternate embodiments, the bare rubber can be sprayed with well known silicone containing lubricating agents or such silicone agents can be otherwise applied to the strands of bare rubber to reduce such catch and the resulting elongation of the bare rubber which otherwise occur during the knitting process, however, this is not preferred as it is believed that silicon lubricating agents can have negative effects on commonly used knitting machines of the type that are envisioned as being helpful in the present knitting process. The preferred non-elastic yarn used for the tuck stitch is spun polypropylene yarn, preferably 200 denier polypropylene yarn purchased from Hickory Throwing (Hickory, N.C.).

BRIEF DESCRIPTION OF THE DRAWINGS

In the drawings, in which corresponding reference numerals and letters indicate corresponding parts of the various embodiments of the present invention throughout the several views, and in which the various embodiments generally differ only in the manner set forth herein or otherwise described and/or shown.

DETAILED DESCRIPTION OF THE INVENTION

Figure 1:
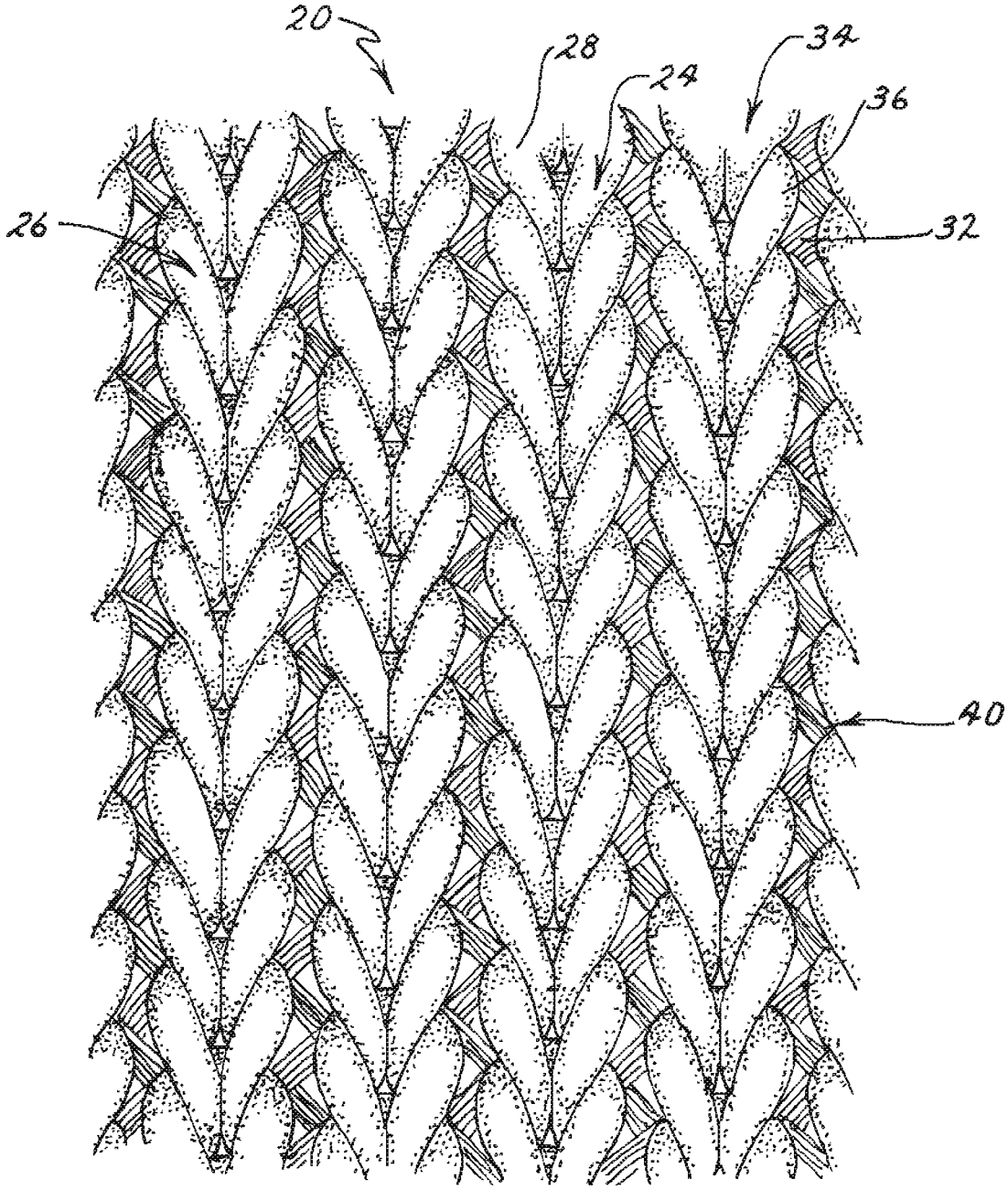
FIG. 1 is a front elevation of a magnified view of a preferred embodiment of the modified jersey knit fabric of the present invention showing a plurality of repeating rows of jersey stitch on the front of the modified fabric, wherein the repeating rows of the jersey stitch on the front are preferably made with bare rubber strand material that is knitted on a flatbed knitting machine and are joined together with a similar jersey stitch pattern on the rear side (not shown) that is preferably joined together with the jersey stitch pattern on the front side by non-elastic yarns that form a ribbed tuck stitch structure or pattern (not shown) that holds the bare rubber jersey stitch on the front side together with the bare rubber jersey stitch on the rear side of the modified jersey stitch.

Referring now to the drawings and to FIG. 1 in particular, a preferred fabric 20 of the present invention is shown. The fabric 20 includes a jersey stitch pattern 24 shown on the front side 26 of the fabric 20. The jersey stitch pattern 24 is preferably made from uncovered strands of bare rubber 28. The yarn 32 that appears between the vertical rows 34 of jersey stitch loops 36 is non-elastic yarn 32, preferably spun polypropylene yarn, that is a part of a tuck stitch matrix 40, limited parts of which are shown schematically in FIG. 2-4 and also in FIGS. 5A-5D and FIGS. 6A-6F, each of which is described in part above.

Figure 2:
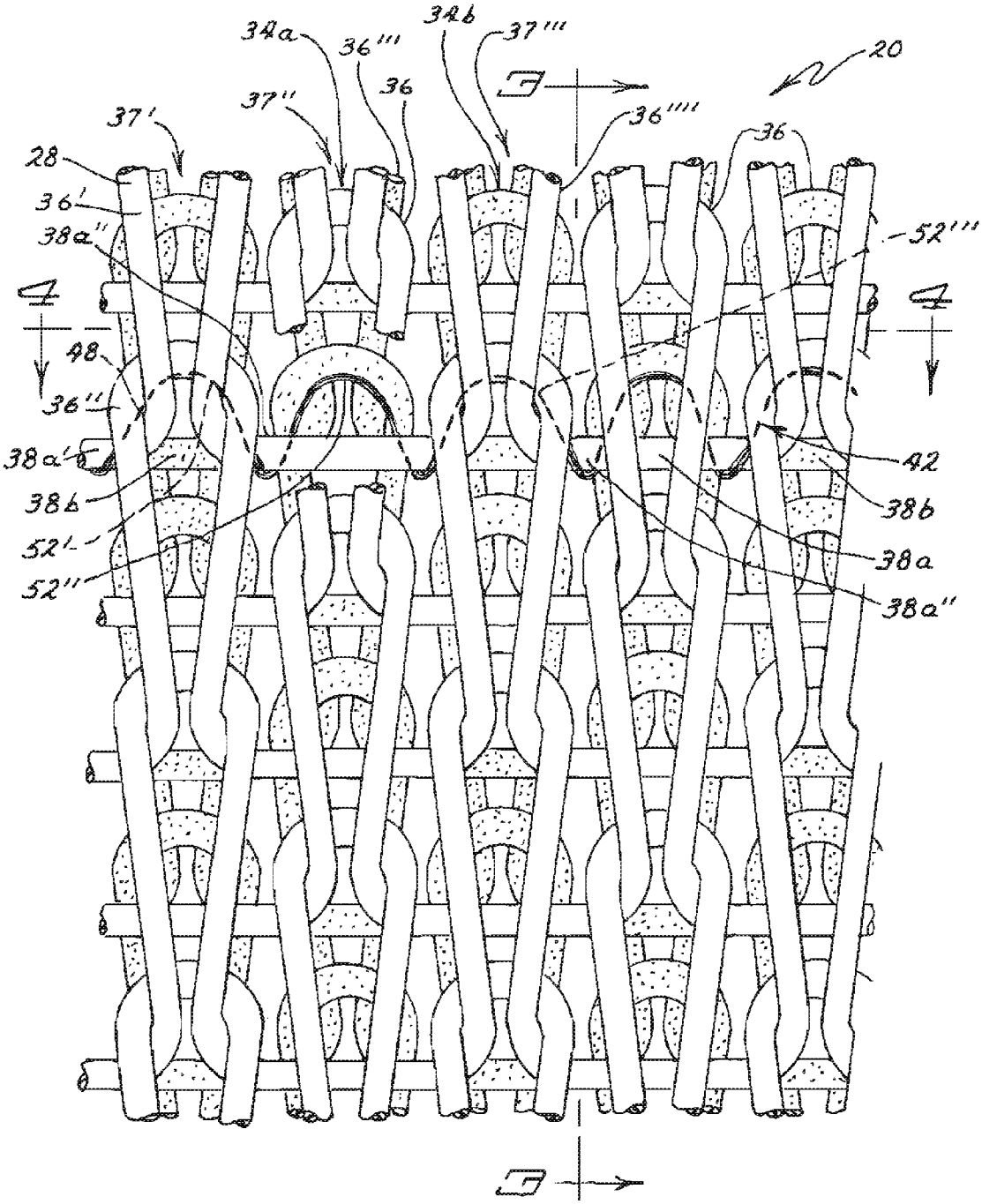
FIG. 2 is a partially broken away schematic front elevation of the modified jersey knit fabric of FIG. 1 in which the jersey stitch patterns on both sides of the fabric are shown schematically as if the fabric were stretched along the x, y and Z axes (i.e., horizontally, vertically and into the thickness of the fabric seen in the front elevation) and the non-elastic yarn used to hold the jersey stitch pattern on the front side and the jersey stitch pattern on the rear side together is removed for clarity, with the exception of one non-elastic yarn that is shown schematically partially in hidden line to shown how the non-elastic yarn tuck stitch ties the jersey stitch pattern on the front side to the jersey stitch pattern on the rear side and a portion of a single jersey stitch loop in the second vertical row of jersey stitch loops is broken away for clarity to give a better view of a portion of the tuck stitch loop on the back side of the fabric.
Figure 4:
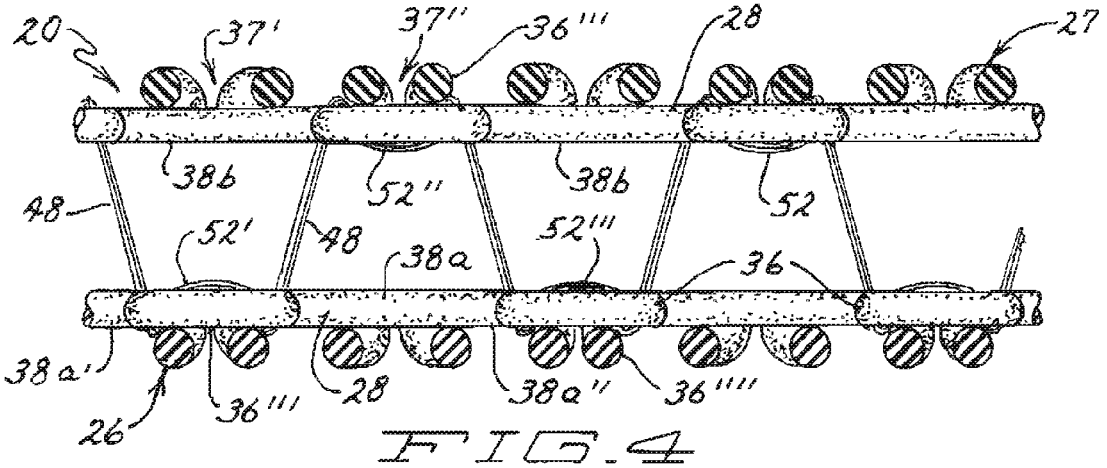
FIG. 4 is a top plan cross-sectional view of the schematic view shown in FIG. 2 from the line 4-4 of FIG. 2.
Figure 3:
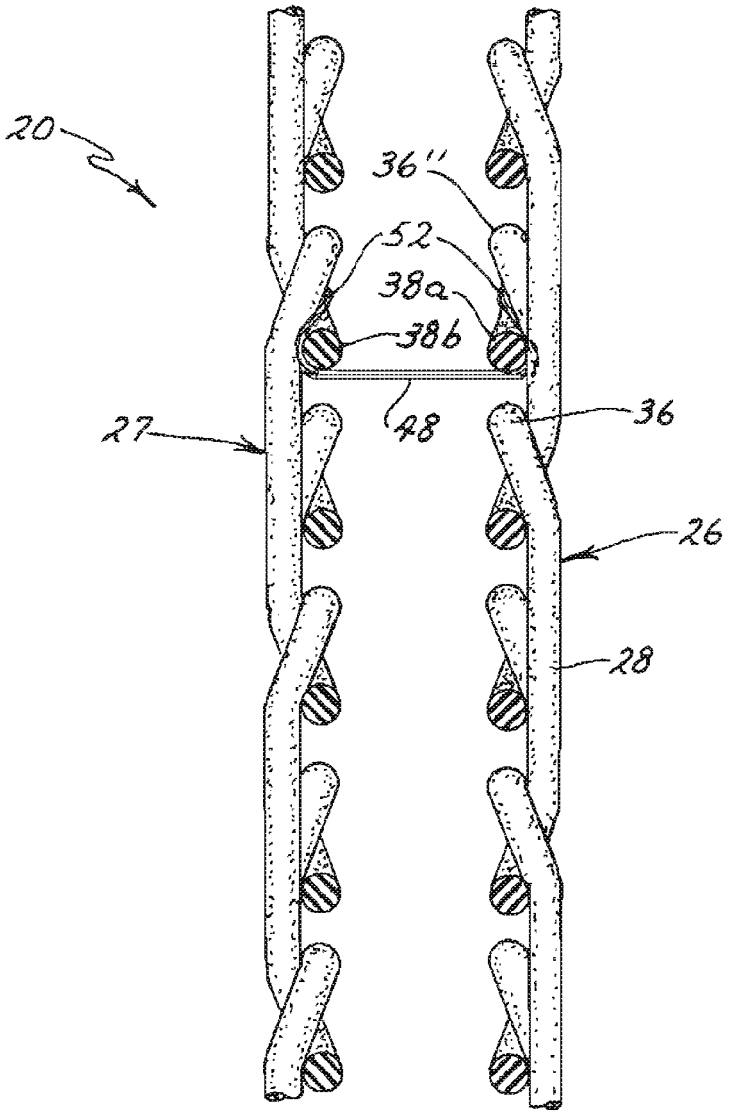
FIG. 3 is a side cross-sectional view of the schematic view shown in FIG. 2 from the line 3-3 of FIG. 2.
Figure 5A:
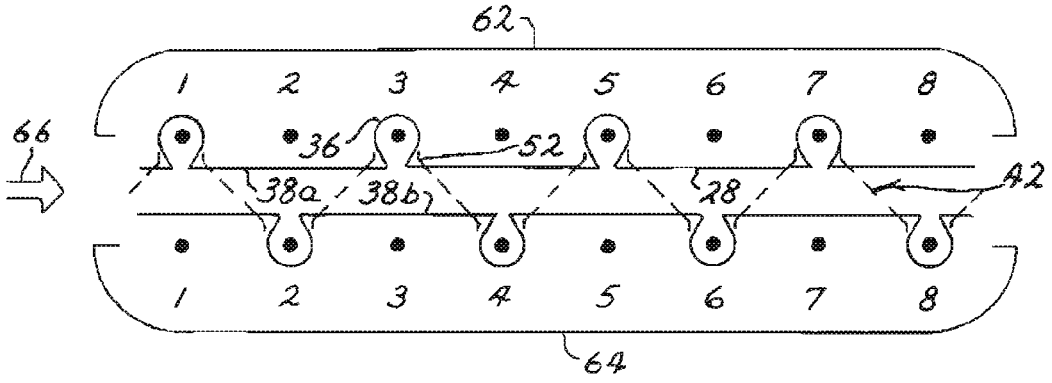
FIG. 5A is a schematic view of a technical representation of a single pass made from left to right in a 3-system knitting machine when the knitting machine accomplishes the following three tasks sequentially going from left to right in a single pass: first, lays down a non-elastic yarn in a ribbed tuck stitch, which goes back and forth between alternating needles on the front bed of a flatbed knitting machine and needles on the back bed of such a machine, in which every other needle on each of the respective front and back beds are missed; second, lays down a jersey stitch on alternating needles of the front bed; and third, lays down a jersey stitch on alternating needles of the back bed, wherein every other needle is skipped on each side of the bed in an alternate manner and each needle that is not skipped is a needle is one around which a tuck stitch is present; In this schematic view, as in the others, i.e., 5B-5D and 6A-6F, it is noted that each needle bed is represented by only eight needles so the patterns can be shown, but it will be appreciated that a single pass will involve more that just eight needles on each of the respective front and back needle beds and that eight is just a representative number.
Figure 5B:
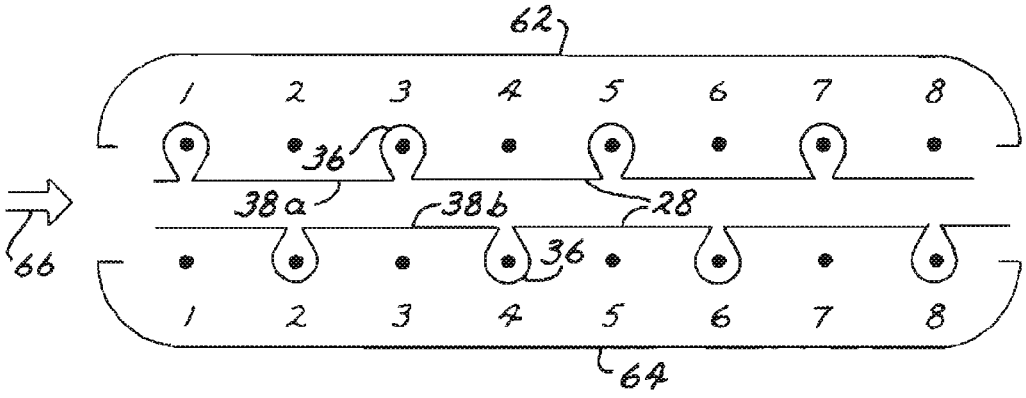
FIG. 5B is a schematic view of a technical representation of a single pass made in a 3-system knitting machine going from left to right as shown in FIG. 5A when the knitting machine: first, lays down a non-elastic yarn in a ribbed tuck stitch, which goes back and forth between alternating needles on the front bed of a flatbed knitting machine and needles on the back bed of such a machine, in which every other needle on each of the respective front and back beds are missed; second, lays down a jersey stitch on alternating needles of the front bed; and third, lays down a jersey stitch on alternating needles of the back bed, wherein every other needle is skipped on each side and each needle that is not skipped is a needle is one around which a tuck stitch is present, but only showing the representation of the two jersey stitch steps or functions shown in FIG. 5A.

Referring now also to FIGS. 2-4, these further stretched drawings attempt to shown the fabric 20 of the present invention in a way that will provide a better understanding of how this fabric is made. In these figures, most of the non-elastic yarn 32 of the tuck stitch matrix 40 (shown in FIG. 1) has been removed for clarity, so that the jersey stitch pattern 24 on both the front and back sides 26, 27 of the fabric 20 can be seen, albeit in a stretched schematic format provided in these figures. As shown in FIG. 2, the jersey stitch pattern 24 on the front side 26 is repeated in alternate columns or vertical rows of jersey stitch loops 34*a*, 34*b*, respectively, on the front side 26 and the back side 27 of the fabric 20. This is consistent with the technical drawings shown in FIGS. 5A-5D, where the jersey stitch pattern 24 is shown to include jersey stitch loops 36 around needles on the front side 26 (i.e., needles 1, 3, 5 and 7 on the front bed 62) that alternate with needles 2, 4, 6 and 8, where jersey stitch loops 36 are laid down on the back side 27 in the same pass. FIG. 5A also shows that the tuck stitch pattern 42 includes loops 52 laid down on all of the same needles where the jersey stitch pattern 24 includes a jersey stitch loop 36.

FIG. 2 shows a series of strands of bare rubber 28, preferably uncovered and at least partially coated strands of bare rubber 28, laid down in a jersey stitch pattern 24 in which the respective jersey stitch loops 36 extend upward from horizontally extending strands 38*a* on the front sides 26 and 38*b* on the back side 27 of the fabric 20. As the strands of bare rubber 28 of the respective loops 36 extend upward through the loop 36 below in the vertical row of jersey stitch loops 34*a*, 34*b* on either side 26, 27 of the fabric 20, the strand of bare rubber 28 turns upward on both sides of the loop 36 from the horizontal orientation of the strand of bare rubber 28 on both sides thereof that enter into a space partially encircled by a loop 28 immediately below in the respective vertical rows 34*a*, 34*b*. As shown partially in hidden line in FIG. 2, the non-elastic yarn 48 comes from behind the horizontally extending base 38*a* of a first loop 36' that is partially broken away in FIG. 2 and resides in the first vertical row 37' of jersey stitch loops 36 on the front side 26. The non-elastic yarn 48 then continues looping up behind the second jersey stitch loop 36" in the first vertical row 37' to form a tuck stitch loop 52' is shown only in hidden line, that resides behind the second jersey stitch loop 36". When the non-elastic yarn 48 comes out from behind the second jersey stitch loop 36" and is visible again in FIG. 2, it is located proximate the far side of the base of the tuck stitch loop 52', where the non-elastic yarn 48 turns back behind the horizontally extending base 38*a'* of the first loop 36' and then goes back behind the front side 26 to the back side 27 of the fabric 20 as shown particularly in FIGS. 3 and 4. The non-elastic yarn 48 then wraps underneath and around the near side of a horizontally extending strand of bare rubber 28 that forms a base 38*b* (shown in FIG. 4) on the near side of a third jersey stitch loop 36'" (that is shown partially broken away in FIGS. 2 and 4) on the back side 27 of the fabric 20 in the second vertical row 37". The non-elastic yarn 48 then continues around and under the horizontally extending base 38*b* on the far side of the third jersey stitch loop 36'" and then returns to the front side 27 to continue under and around the near side of horizontally extending base 38*a"* of a fourth jersey stitch loop 36"" (that is shown partially broken away in FIGS. 2 and 4) on the front side 26 of the fabric 20 in the third vertical row 37'", where the non-elastic yarn 48 begins to repeat the tuck stitch pattern 42, forming another tuck stitch loop 52'" on the front side and then repeating the tuck stitch pattern previously described by traveling back to the back side 27 in that same manner as before, but proximate the next adjacent vertical row.

Figure 5C:
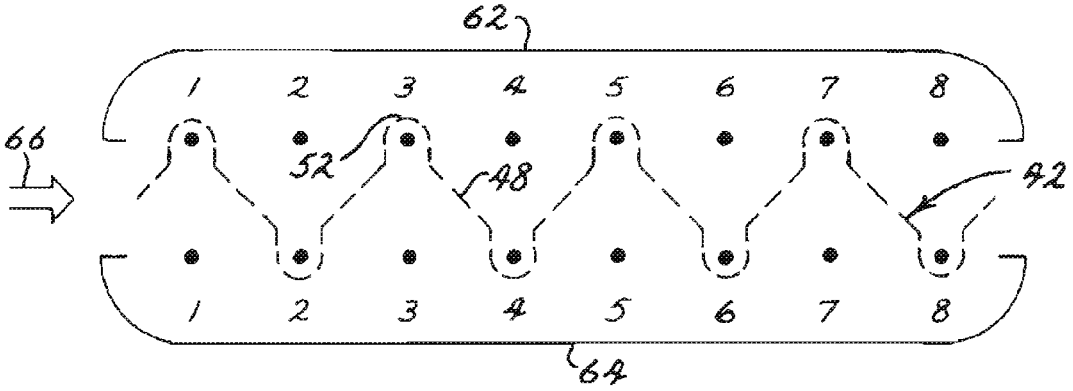
FIG. 5C is a schematic view of a technical representation of a single pass made in a 3-system knitting machine going from left to right as shown in FIG. 5A when the knitting machine: first, lays down a non-elastic yarn in a ribbed tuck stitch, which goes back and forth between alternating needles on the front bed of a flatbed knitting machine and needles on the back bed of such a machine, in which every other needle on each of the respective front and back beds are missed; second, lays down a jersey stitch on alternating needles of the front bed; and third, lays down a jersey stitch on alternating needles of the back bed, wherein every other needle is skipped on each side and each needle that is not skipped is a needle is one around which a tuck stitch is present, but only showing the representation of the tuck stitch functions shown in FIG. 5A.
Figure 5D:
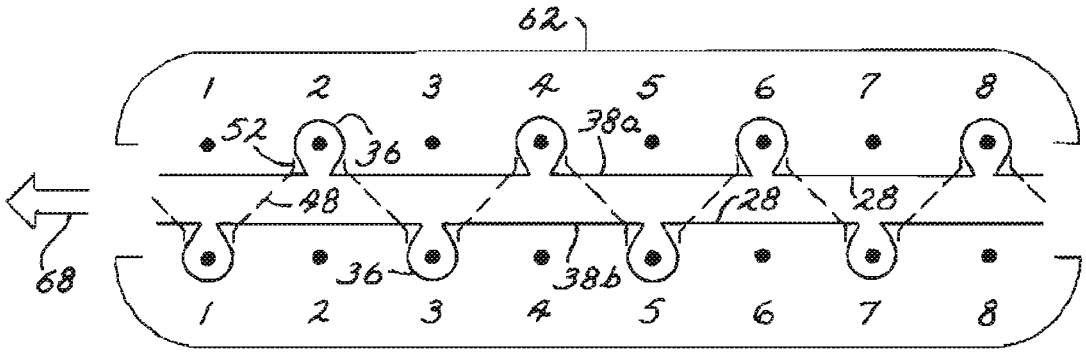
FIG. 5D is a schematic view of a technical representation of a single pass made from right to left in a 3-system knitting machine when the knitting machine accomplishes the following three tasks sequentially going from right to left in a single pass that follows a single pass in a 3-system knitting machine after the 3-system knitting machine has completed a pass from left to right as shown schematically in FIG. 5A: where all the same functions are accomplished but from right to left, wherein the machine: first, lays down a non-elastic yarn in a ribbed tuck stitch, which goes back and forth between alternating needles on the front bed of a flatbed knitting machine and needles on the back bed of such a machine, in which every other needle on each of the respective front and back beds are missed; second, lays down a jersey stitch on alternating needles of the front bed; and third, lays down a jersey stitch on alternating needles of the back bed, wherein every other needle is skipped on each side of the bed in an alternate manner and each needle that is not skipped is a needle is one around which a tuck stitch is present and wherein the needles on the front bed and the back bed that where skipped when the knitting machine passes from left to right are the needles that are not skipped when the knitting machine passes from right to left.

Referring now also to FIGS. 5A-5D, which provide schematic illustrations of technical representations of passes made on a 3-system knitting machine (not shown) programmed to make a fabric of the present invention. In FIG. 5A, a schematic illustration is provided to represent three different knitting functions that the 3-system machine will undertake and complete in a single pass moving from left to right 66, while making the fabric 20 of the present invention, in which the machine knits on alternate needles 1, 3, 5, and 7 of the front bed 62 and alternate needles 2, 4, 6 and 8 of the back bed 64 (see also FIG. 5B, which also illustrates these two knitting functions) to form a jersey stitch on both the front bed 62 and the back bed 64, and also lays down tuck stitch loops 52 on both the front bed 62 and the back bed 64, as also shown in FIG. 5C, where it can be seen easily that the non-elastic yarn 48 forming the tuck stitch lays down loops 52 alternately starting on the front side 62 on needle 1, then on the back side 64 on needle 2 and then back and forth between the two sides 62, 64 and on alternate needles on each of the two sides. This pattern is essentially reversed, as is shown in FIG. 5D, when the 3-system machine continues knitting a fabric 20 of the present invention as it makes a return pass, this time moving from right to left 68 and laying down jersey stitch loops 36 on alternate needles 8, 6, 4 and 2 on the front side 62 and on alternate needles 7, 5, 3 and 1 on the back side 64. As shown, the 3-system machine will also lay down a series of tuck stitch loops 52 alternating from side to side and also skipping every other needle on each side just as in the pattern established in the first pass, but essentially in a reversal of the first pass and on the needles that were skipped in the first pass. It will be appreciated that the passes described herein are illustrative of a pattern that is followed by the knitting machine and that each knitting bed will be much longer and the many passes will be required before a fabric 20 of a desired size will be completed.

Figure 6A:
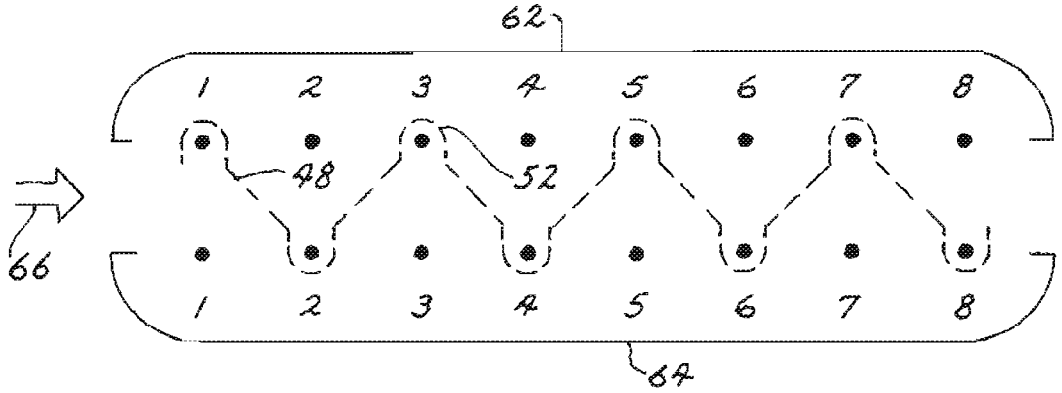
FIGS. 6A, 6B and 6C are schematic views of a series of technical representations of knitting functions completed by a single-system knitting machine, which is capable of carrying out only a single knitting function on each pass either from left to right or from right to left, in a series of passes when the knitting machine is programmed to make the modified jersey stitch fabric of the present invention; wherein the single-system knitting machine: first, lays down a first non-elastic yarn in a first ribbed tuck stitch, which goes back and forth between alternating needles on the front bed of a flatbed single-system knitting machine and needles on the back bed of such a machine in a first pass that goes from left to right as shown in FIG. 6A, in which every other needle on each of the respective front and back beds are missed; second, lays down a jersey stitch on alternating needles of the front bed in a second pass that goes from right to left as shown in FIG. 6B, wherein every other needle is skipped on the front bed; and third, lays down a jersey stitch on alternating needles of the back bed in a third pass that goes from left to right as shown in FIG. 6C, wherein every other needle is skipped on the back bed; wherein each needle that is not skipped on each the respective sides is a needle around which a tuck stitch is present.
Figure 6B:
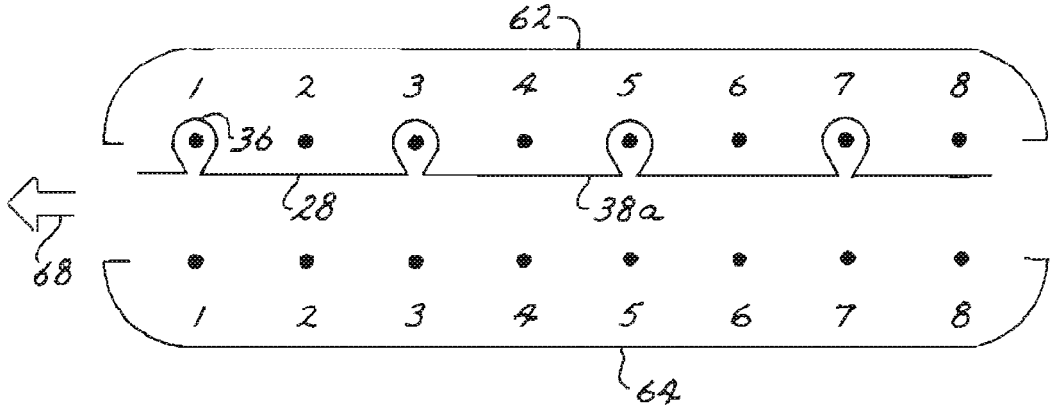
Figure 6C:
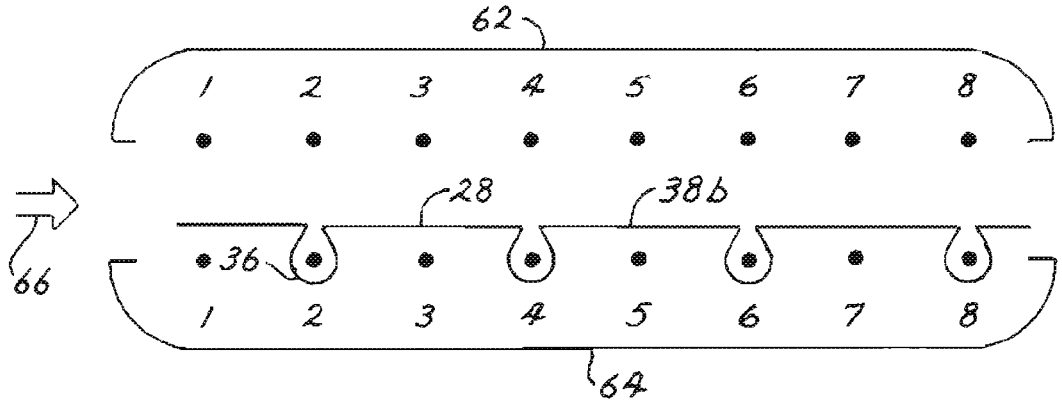

Referring now to FIGS. 6A-6F, a programmed knitting pattern is illustrated for knitting on a single function or single system knitting machine (not shown). In this instance each pass will permit the machine to only undertake a single function when the machine knits from either left to right 66 or from right to left 68. In the schematic illustrations of the technical representations shown in FIGS. 6A-6F, each pass will only allow a single function and it will take the six passes shown in FIGS. 6A to 6F to complete the six function shown in the first pass from left to right 66 in FIG. 5A and the second pass from right to left 68 in FIG. 5D. In FIG. 6A, the single system knitting machine lays down a series of tuck stitch loops on alternate sides 62, 64 while moving from left to right 66, as also shown in FIG. 5C. In FIG. 6B, however, the single system knitting machine is moving from right to left 68 and is placing jersey stitch loops 36 on alternating needle on the front side that correspond to the alternating needles on the front side 62 that receive tuck stitch loops 52 on the front side in the pass from left to right 66 shown in FIG. 6A. In FIG. 6C, a subsequent pass from left to right 66 that lays down another series of jersey stitch loops 36 is illustrated, but this time on alternating needles on the back bed 64. In a return pass from right to left 68 illustrated in FIG. 6D, the single system knitting machine will then lay down another series of tuck stitch loops 52 on alternate beds and skipping every other needle on each side. In the subsequent two passes illustrated respectively in FIGS. 6E and 6F, the single system knitting machine will respectively lay down a series of jersey stitch loops 36 on alternating needles 2, 4, 6 and 8 while moving from left to right 66 on the front bed 62 and then lay down a series of further jersey stitch loops 36 on alternating needles 7, 5, 3 and 1, while moving from right to left 68 on the back bed 64 to complete a series of passes that are the equivalent of the two passes made by the 3-system knitting machine that are schematically illustrated in FIGS. 5A and 5D.

As described herein, the present invention provides a modified knit structure fabric produced on flat bed knitting machinery. Depending upon the intended use of the fabric, the combination of performance properties that are desired may vary. In preferred embodiments, desired performance properties will include superior stretch recovery, moisture passage and non-absorption, breathability, enhance microbial growth resistance, heat resistance, superior cushioning, resistance to degradation due to exposure to sunlight and UV radiation and enhanced skid resistance on the surfaces of the fabric. As used herein, the phrase "stretch recovery" means the ability of a fiber or fabric to elongate and return to its original length or shape. As used herein, the phrase "moisture passage" means the channeling of moisture into or through the fabric and away from an object in contact with the surface of the fabric, and further releasing the moisture from the outside or exposed surface of the fabric into the atmosphere. Moisture passage is sometimes also referred to as "wicking." As used herein, the term "breathability" means the rate at which water vapor passes through the fabric, in units of grams of water vapor per square meter of fabric per 24 hour period ($g/m^2/day$). Generally, breathability can be measured at room temperature (22° C.) at one atmosphere of pressure. As used herein, the term "microbial growth resistance" means inhibiting or reducing the growth of microorganisms such as bacteria, fungi, or protozoans. As used herein, the phrase "skid resistance" means minimizing skidding or sliding upon the when there is surface to surface contact. As used herein, the term "yarn" refers to a continuous strand of textile fibers, filaments or material in a form suitable for knitting, weaving or otherwise intertwining to form a textile fabric. Yarn can occur in a variety of forms including but not limited to a spun yarn consisting of staple fibers usually bound together by twist; a multi-filament yarn consisting of many continuous filaments or strands; or a monofilament yarn which consists of a single strand. As used herein, the phrase "bed" or "needle bed" refers to a flat metal plate with slots at regular intervals in which the knitting needles slide on a knitting machine. As used herein, the phrase "half gauge" refers to the number of needles per particular unit in the knitting machine. Half gauge is half the number of needles in a given unit, as a half gauge knit fabric is knit on every other needle. As used herein, the phrase "weft knitting" refers to a method of knitting wherein one continuous thread runs crosswise in the fabric, forming all of the loops in one pass.

As used herein, the phrase "jersey knit" or "jersey knit stitch" refers to a plain knit stitch that requires only one bed for knitting. A jersey knit fabric has a knit face and a pearl back. In a tuck stitch, the needles in the upper knitting position do not knit, but an extra loop of yarn is laid over the needles. The extra loop is not intermeshed through the old loop but is tucked in behind it on the reverse side of the stitch. When these needles are returned to a knitting position, all the loops on the needle are knit in a single stitch, resulting in a textured fabric. As used herein, the phrase "rib structure" refers to a knitted fabric that utilizes a plain stitch that is knit on the front and back beds alternately in one pass as in a 1×1 Rib, or any combination of formations such as a 2×2 or 2×1 Rib. As used herein, the phrase "tubular knit" or "tubular knit structure" refers to a fabric that is knit on two separate beds of a knitting machine but is formed as a single tube without seams.

The present invention provides a modified knit structure fabric formed on a conventional two bed knitting machine, such as a flatbed knitting machine. The fabric has a first and a second layer of knit fabric and the knit fabric is preferably jersey knit. The two layers of knit fabric are further joined to each other by rows of tuck stitches wherein the tuck stitches form a third layer in between the knit fabric layers. In one embodiment, the fabric of the present invention is formed by a method comprising a) forming one or more rows of jersey knit stitch on both the front and back beds of the knitting machine, wherein the same number of rows of jersey knit stitch are formed on the front and back bed, b)

forming one or more rows of tuck stitches across the front and back beds to connect the rows of jersey knit stitches formed on the front and back beds in step a), and repeating steps a) and b) until the knit fabric is of the desired size. For example, two rows of jersey knit stitch can be formed on the front bed, two rows of jersey knit stitch can be formed on the back bed, and then one or two rows of tuck stitches can be formed across the front and back beds to connect the jersey knit stitches formed on the front and back beds. In another embodiment, the fabric is formed by a method comprising i) forming a single row of tuck stitches across both beds, ii) forming a row of jersey knit stitch on the front bed and a row of jersey knit stitch on the back bed, iii) forming a single row of tuck stitches across both beds, iv) forming a row of jersey knit stitch on the front bed and a row of jersey knit stitch on the back bed, and v) repeating steps i) through iv) until the knit fabric is of the desired size. In one embodiment, the tuck stitches are formed across both the front and back beds of the knitting machine and can, for example, be formed by using every needle, alternating needles, or every third or fourth needle on the knitting machine. In one embodiment, the first and second layers of jersey knit fabric are formed as a half gauge tubular knit structure and are joined together by a third layer of tuck stitches formed on alternating needles as a 1×1 rib structure. In a preferred embodiment, the first layer and the second layer are formed with jersey knit stitches and are further joined together by a third layer of tuck stitches wherein the pearl backs of the first and second jersey knit layers are facing each other.

In one embodiment, the jersey knit can be made from a strand of elastomeric material, preferably a strand of bare rubber. In preferred embodiments, the tuck stitch is made from non-elastic yarn. In another embodiment, the tuck stitches can be made from an elastomeric yarn. In a further embodiment, the elastomeric yarn is a strand or a plurality of strands of bare rubber, and preferably bare natural rubber. Preferably, the rubber is extruded rubber. Bare natural rubber is typically derived from natural rubber latex. However, synthetic rubber is also suitable, especially in applications where latex allergy is of concern. In one embodiment, a strand of rubber is any gauge rubber of from about 10 to about 80 gauge, preferably from about 22 to about 66 gauge; more preferably from about 30 to about 50 gauge and most preferably about 38 gauge.

In further embodiments, the tuck stitches will be made from natural or synthetic non-elastic polymeric yarn, preferably synthetic yarn made from thermoplastic resins, preferably polypropylene, more preferably from spun polypropylene. In another embodiment, the jersey knit stitches can be made at least in part from polypropylene. Preferably, the polypropylene yarn is a continuous filament yarn. In one embodiment, the polypropylene yarn is any denier polypropylene yarn from about 100 to about 300 denier, more preferably from about 150 to about 250 denier, most preferably about 200 denier.

In a preferred embodiment, two different materials are used to form the modified knit structure fabric. Most preferably, one material is strands of bare rubber and the other material yarn is polypropylene yarn.

The fabric of the present invention can be used in a number of applications including yoga and exercise mats; upholstery applications such as free standing or built-in indoor and outdoor furniture; exercise apparel; medical applications such as wound dressings and athletic or garment support wraps; military applications such as combat utility uniforms (CUU) and temporary shelters; the aeronautic, recreational vehicle, and automotive industries including upholstery or interior fabrics such as roof, trunk or other linings; mats used for place settings in restaurants and cafeterias; camping and other outdoor recreational equipment; nursery or other primary grade schools where mats are utilized; footwear; attire such as gloves or socks; and mats such as those used in commercial kitchens, hospitals, spas, hotels or other areas where mats with the properties of the present invention are desired. Depending upon the overall thickness of the fabric desired the gauge or denier of one or more of the yarns can be increased or decreased accordingly. Furthermore, depending upon the application of the fabric, one skilled in the art can select the appropriate yarn to form the jersey knit and the appropriate yarn to form the tuck stitch. For example, in applications that a non-skid surface is desired, the jersey knit stitch can be made with rubber yarn and the tuck stitch can be made with a polypropylene yarn. Alternatively, in applications such as outdoor furniture, a softer exterior of the fabric may be desired and, therefore, the jersey knit stitch can be made from polypropylene yarn and the tuck stitch can be made from rubber yarn. A combination fabric comprising one or more components wherein the jersey knit stitch is made with rubber yarn and the tuck stitch is made with a polypropylene yarn is contiguous with one or more components wherein the jersey knit stitch is made from polypropylene yarn and the tuck stitch is made from rubber yarn, is also contemplated. The combination fabric can be continuously knit or knit as separate fabrics that are further joined together by one or more means well known in the art. The combination fabric can be made to provide a fabric with decorative and/or functional features including aesthetic designs or borders.

In certain applications, more or less stretch in the fabric may be desired. In one embodiment, the fabric of the present invention is a four way stretch fabric. Generally, the stretch in the fabric of the present invention is provided by the rubber yarn incorporated into the fabric. The amount of stretch of the finished fabric can be controlled by a number of variables. In one embodiment, the amount of stretch is controlled by the type of elastomeric yarn selected. In another embodiment, wherein the jersey knit stitch is formed by strands of bare rubber and the tuck stitch is formed by the polypropylene yarn, the spacing of the tuck stitch can be utilized to control the overall amount of stretch in the fabric. For example, if less overall stretch of the fabric is desired, the tuck stitch can be formed on every needle and will, therefore, provide tuck stitches that are relatively close together in the fabric and will result in less overall stretch of the fabric. Alternatively, when more stretch is desired, the tuck stitch can be formed on every third or fourth needle, resulting in relatively more space between the tuck stitches and further resulting in more stretch in the finished fabric.

The fabric of the present invention provides multiple advantages over fabrics previously described or those made from only rubber yarn or only polypropylene yarns, or combinations of other yarn types with similar modified knit structures. In one embodiment, the modified knit structure fabric of the present invention comprises the combination of rubber yarn and polypropylene yarn and provides a fabric with a variable amount of stretch in the fabric as described above and further provides superior stretch recovery. The phrase "superior stretch recovery" is understood by those skilled in the relevant art but can include, but is not limited to, the meaning wherein superior stretch recovery of the fabric of the instant invention is as compared to a knit fabric made solely from rubber yarn or solely from polypropylene yarns, a knit fabric comprising one or more other yarn types with a similar knit structure, or a fabric constructed with rubber yarn and polypropylene yarn but with a different knit structure. The superior stretch recovery of the fabric of the present invention is provided by the knit structure of the fabric and the selection of the combination of yarns.

In addition to superior stretch recovery, the fabric of the present invention further provides advantageous properties as a result of the knit structure and the specific selection of the combination of bare rubber and polypropylene yarns. These properties include, but are not limited to, moisture passage, breathability, antimicrobial, heat and sun resistance, cushioning, and non-skid surface.

Another aspect of the invention provides a method for forming a modified knit structure fabric. In one embodiment, the invention provides a method for forming a modified knit structure fabric on a double bed flatbed knitting machine comprising a front needle bed and a back needle bed, wherein the fabric comprises polypropylene yarn and bare rubber yarn, and the fabric further comprises five or more properties selected from the group consisting of superior stretch recovery, superior moisture passage, superior breathability, superior microbial growth resistance, superior heat and sun degradation resistance, superior cushioning, and superior skid resisting surfaces.

The present invention includes a method of making a modified knitted fabric, comprising a) forming one or more rows of jersey knit stitch on both the front and back beds of the knitting machine, wherein the number of rows of jersey knit stitch formed is the same on both the front and back beds, b) forming one or more rows of tuck stitches connecting the rows of jersey knit stitches formed on the front and back beds in step a), and c) repeating steps a) and b) until the knit fabric is of the desired size. In a particular embodiment, the number of rows of jersey knit stitch formed in step a) is two on the front bed and two on the back bed, and the number of rows of tuck stitches formed in step b) is one or two. In another embodiment, the invention provides a method for forming a modified knit structure fabric on a double bed flatbed knitting machine comprising a front needle bed and a back needle bed, wherein the fabric comprises polypropylene yarn and bare rubber yarn, and the fabric further comprises five or more properties selected from the group consisting of superior stretch recovery, superior moisture passage, superior breathability, superior microbial growth resistance, superior heat and sun degradation resistance, superior cushioning, and superior skid resisting surfaces; the method further comprising i) forming a single row of tuck stitches across both beds, ii) forming a single row of jersey knit stitch on the front bed and a single row of jersey knit stitch on the back bed, iii) forming a single row of tuck stitches across both beds, iv) forming a single row of jersey knit stitch on the front bed and a single row of jersey knit stitch on the back bed, and v) repeating steps i) through iv) until the knit fabric is of the desired size. In another embodiment, the method further comprises the tuck stitches being formed on every needle, every other needle, every third needle, or every fourth needle of the knitting machine. In a particular embodiment, the method further comprises the tuck stitches being formed on every other needle to form a 1×1 rib structure. In one embodiment, the method further comprises forming the jersey knit stitches on every other needle to form a half gauge tubular knit structure.

In one embodiment, the fabric of the present invention can be knit on a 3-system knitting machine and structured as shown in the technical drawings shown in FIGS. 5A-5D. In the first pass, as shown in FIG. 5A, the knitting machine operation goes from left to right 66 on both the front needle bed 62 and on the back needle bed 64 and forms a tuck stitch that alternates from the front bed 62 to the back bed 64, starting with needle 1 on the front bed, then going to needle 2 on the back bed, then back to needle 3 on the front bed and continuing to alternate between the front bed and the back bed until the tuck stitch has been placed on needles 1, 3, 5, 7 on the front bed and needles 2, 4, 6, 8 of the back bed. This stitch is also shown in FIG. 5C. In the same pass, the 3-system machine creates a jersey stitch on needles 1, 3, 5, 7 on the front bed and also separately creates jersey stitch on needles 2, 4, 6, 8 of the back bed as shown in FIG. 5A and separately in FIG. 5B. Following the first pass shown schematically in FIG. 5A, which goes from left to right, the knitting machine will make a second pass from right to left, as shown in FIG. 5D. In this second pass, the needles on the front and back needles beds that were skipped in the first pass are not skipped and the needles that were not skipped in the first pass are skipped in the second pass. The 3-system knitting machine will continue to repeat these respective passes in order, repeating each of these functions until the knitting operation is halted.

Figure 6D:
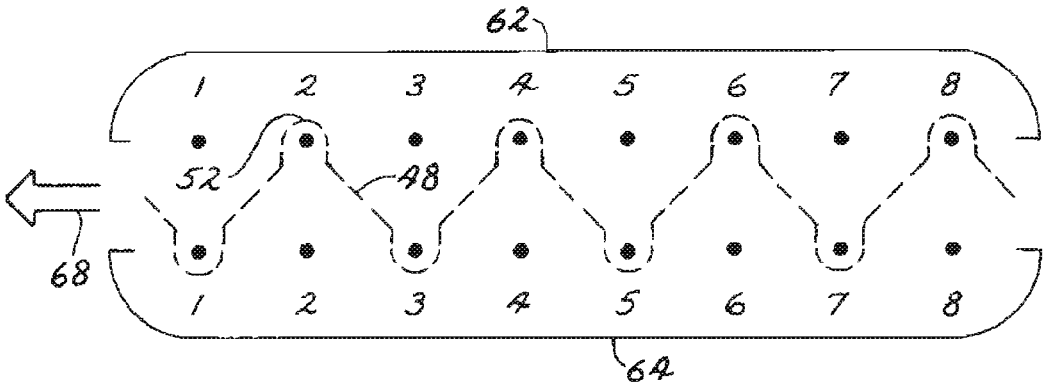
FIGS. 6D, 6E and 6F are schematic views of a further series of technical representations of knitting functions completed by a single-system knitting machine, which would follow the steps or functions disclosed in FIGS. 6A, 6B and 6C in a series of further passes when the knitting machine is programmed to make the modified jersey stitch fabric of the present invention; wherein the single-system knitting machine: first, lays down a second non-elastic yarn in a second ribbed tuck stitch, which goes back and forth between alternating needles on the front bed of a flatbed single-system knitting machine and needles on the back bed of such a machine in a further pass that goes from right to left as shown in FIG. 6D, in which every other needle on each of the respective front and back beds are missed and wherein the needles that were skipped in the pass described in FIG. 6A are not skipped in this further pass; second, the single-system machine lays down a further jersey stitch on alternating needles of the front bed in a second pass that goes from left to right as shown in FIG. 6E, wherein every other needle is skipped on the front bed, but that the needles that were skipped on the pass disclosed in FIG. 6B are not skipped in this further pass; and third, the single-system machine lays down a further jersey stitch on alternating needles of the back bed in a further pass that goes from right to left as shown in FIG. 6F, wherein every other needle is skipped on the back bed; and wherein each needle that is not skipped is a needle around which a tuck stitch is present and each of those needles where needles that were skipped in the pass described in FIG. 6C.
Figure 6E:
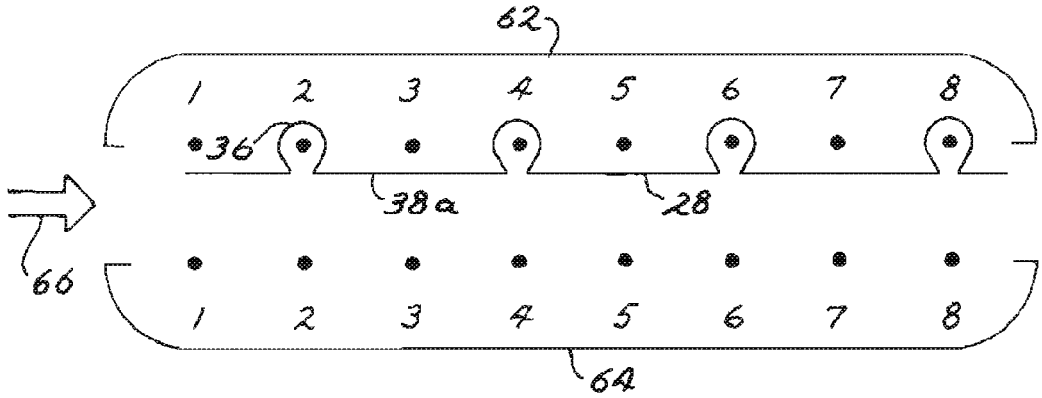
Figure 6F:
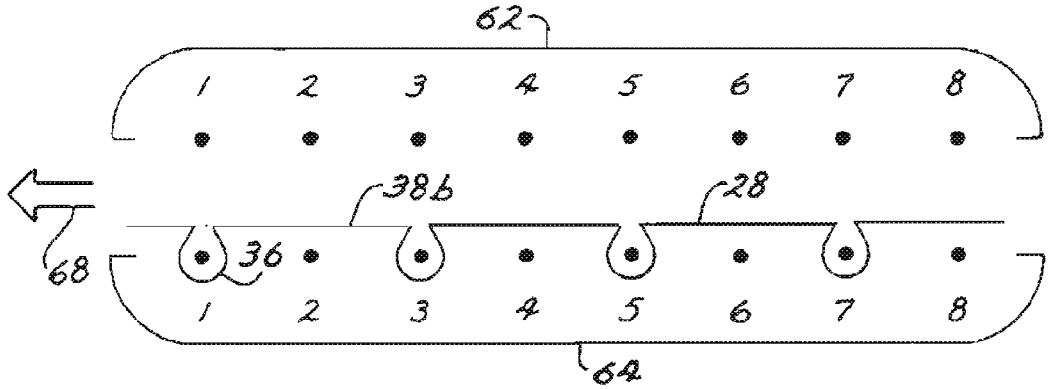

Further, the fabric of the present invention can be formed in accordance with a method of the present invention as disclosed in FIGS. 6A-6F on a single system knitting machine. For example, pass 1, as shown schematically in the technical drawing shown in FIG. 6A, results in a tuck stitch alternating from needles on the front bed to needles on the back bed as the knitting operation moves from left to right, so as to create loops on needles 1, 3, 5, and 7 of the front bed and alternating loops on needles 2, 4, 6, and 8 of the back bed. When pass 1 is completed, a jersey stitch is then formed on alternating needles 7, 5, 3 and 1 of the front bed in a second pass that goes from right to left on the front bed as shown in FIG. 6B. The second pass is followed by a third pass going from left to right on the back bed and knitting on needles 2, 4, 6 and 8 of the back bed as shown in FIG. 6C. As shown in FIG. 6D, a subsequent pass, from right to left lays down a further tuck stitch on both the front bed and the back bed, but this time placing loops on the needles that were skipped in the first pass. As shown sequentially in FIGS. 6E and 6F, subsequent passes follow in which a further jersey stitch is created on the front bed when the machine lays down loops while going from left to right on needles 2, 4, 6 and 8 of the front bed that were missed in the second pass shown in FIG. 6B and then lays down a further jersey stitch when it returns from the right while moving to the left on the back bed as shown in FIG. 6F when loops are placed on needles 7, 5, 3 and 1 that were skipped in third pass shown in FIG. 6C. It will be appreciated that single system knitting machines are programmable just as 3-system machines are and that other knitting orders may be used to obtain the same or similar results. Further more, it will also be appreciated that the respective programmable functions or actions of these respective knitting machines can be repeated until the knit fabric is of the desired size.

It is well known in the art that machine knitting with strands of bare rubber is challenging at best as bare rubber tends to catch and adhere to surfaces as it is used in a knitting process and it is subject to stretching, breaking, and/or sticking to the needles or other components of the knitting machine, such as feeding mechanisms, resulting in undesirable properties such as dropped or uneven stitches, malformed fabrics that do not lie flat, or fabrics that are not properly shaped. Many of the difficulties previously mentioned are directly related to the fact that strands of bare rubber catch on knitting machine surfaces and then stretch during the knitting process and the amount of stretch of the rubber strands during the knitting process cannot be controlled using conventional feeding techniques suitable for non-elastomeric yarns or cover elastomeric strands. One approach to solving the problem of machine knitting with strands of rubber that has been employed by the industry is to cover the rubber with a coating of yarn of one kind or another, such as for instance with an outer layer of nylon or non-elastic, or a layer of any other suitable material that generally allows strands of bare rubber to glide freely through the knitting machine and feeding mechanisms. Unfortunately, covering the bare rubber also negates some of the natural properties of bare rubber such as providing a non-skid or gripping surface. In one embodiment, the method of the present invention includes utilizing one or more agents to temporarily coat or at least partially coat the uncovered bare rubber surface of the respective bare rubber strands so that the catch or grab associated with bare rubber as it is drawn over other surfaced made of metal, hard plastic or the like can be temporarily reduced so that the elongation that generally results from such catch or grab when such bare rubber surfaces engage or slide over such metal, hard plastic or other hard surface in a typical knitting process, so that the tendency for elongation of the bare rubber during or prior to the incorporation of the bare rubber into the fabric is reduced or eliminated. In a preferred embodiment, where the agents disclosed elsewhere herein are employed to temporarily reduce or eliminate the grabbing and catching between these respective surfaces that results in the elongation of the uncovered strands of bare rubber will not negate the advantageous properties that the uncovered bare rubber provides in the fabric, because these agents are relatively easy to remove and do not generally require complete removal. In this regard it will be appreciated that using industrial grade Talcum powder has been discovered to be especially cost effective because it comes on the scored sheets of bare rubber from the manufacturer and the distributor. In addition, addition Talcum powder is inexpensive and any remaining Talcum powder on the bare rubber in the finished fabric will desiccate the fabric to at least a limited degree, which adds to the perceived value of this particular agent. Alternatively, unwanted Talcum powder can be blown off of the bare rubber strands after formation of the desired fabrics. As will be appreciated, the bare rubber is typically purchased in a multi-strand ribbon; typically 40 such strands that are extruded individually and join together into a single multi-strand ribbon that is coated with talcum powder and then shipped. Once received, the multiple strands of the multi-strand ribbon must be separated and then wound onto separate cones for later incorporation into the preferred fabric of the present invention. A preferred method of adding powder to the individual strands of bare rubber is to simply added a large amount of talcum powder to the container in which the multi-stranded ribbon is transported, generally a box. The newly added powder will coat the multi-strand ribbon and hence the individual strands as they are drawn out of the container to be separated into separate strands of powder coated bare rubber by a Rubber Separator (as for example a Rubber Separator made by H.H. Arnold Co., Inc., 529 Liberty St., Rockland, Mass. 02370 as an attachment for a Rubber Covering Machine) and subsequently wound onto cones for subsequent use in the knitting process. It will be appreciated that other methods of further coating the individual strands of bare rubber with additional powder will include passing the strands through an additional container containing powder and/or dusting the strands either before or after separation and/or spraying additional powder on the strands either before or after separation. In preferred embodiments the amount of powder on the individual strands of bare rubber will be an amount that is equal to from about 0.5 to about 5.0 percent of the weight of the bare rubber, preferably from about 1.0 to about 4.0 percent of the weight of the bare rubber. In preferred embodiments the powder coating the bare rubber strands will be from about 1.5 to about 3.0 percent of the weight of the bare rubber.

In one embodiment, the yarn feeding apparatus is adjusted such that the rubber yarn is only slightly or not at all elongated when incorporated into the fabric of the present invention. In another embodiment, the bare rubber yarn is temporarily coated with a powder, such as Talcum powder and starch powder or the like, or with silicone or any such other substance that is known to reduce adhesion and catch so that it will allow the bare rubber to pass freely through the yarn feeding equipment and the knitting machine thus reducing or eliminating the elongation caused by when the bare rubber sticks to one or more components of the knitting machine or feeding mechanisms during the knitting process. The powder or silicone can easily be removed after knitting is completed in order to provide the non-skid property of the bare rubber in the finished fabric. In the case of the respective powders, the fabric can blown with air or other gas or gases and/or washed with water or other solvents to remove excess powder or silicone lubricants. Alternatively, or in addition to, the feeding equipment used in conjunction with the flat bed knitting machine can be modified or adjusted in order to overcome the sticking and inconsistent stretch of the bare rubber yarn that is typical of bare rubber yarn being fed into a knitting machine. The yarn feeding equipment controls the amount of tension on the yarns or strand materials that are being fed into the knitting machine as well as the angle and speed at which the yarns are being fed. In order to maintain consistent tension of the rubber yarn, a variable tension setting can be employed wherein the tension is adjusted according to the amount of stretch and tension that the rubber yarn has as it passes through the feeding equipment. In one embodiment, the amount of tension is automatically controlled by the feeding equipment wherein the tension is adjusted according to the increase and/or decrease in the amount of stretch and/or tension sensed in the rubber yarn that was immediately previously fed through the feeding equipment. For example, the method of the present invention can employ the apparatus and methods for feeding and knitting with elastomeric yarns or strand materials as described in published patent application US2011/0010002 and hereby incorporated herein by reference. In preferred embodiment of the present invention the strands of uncovered bare rubber that are preferably at least partially coated with either a moisture absorbing powder or a silicone containing lubrication agent, will be unrolled from a spool of such rubber strand material through one or more Memminger IRO (MI) MSF feeders purchased from MEMMINGER-IRO GmbH (MEMMINGER-IRO GmbH; Jakob-Mutz-Straβe 7; 72280 Dornstetten, Germany).

In another embodiment, the stretch or tension introduced into the rubber yarn during the knitting process of the present invention is minimized by utilizing a roller apparatus for feeding the rubber yarn into the knitting machine. For example, strands of the rubber yarn can be pulled from spindles mounted above the knitting machine and passed through a roller mechanism prior to entering the knitting mechanism. The two or more rollers are positioned very close together and in some configurations are touching each other, with only enough space between the rollers to allow the bare rubber to pass through to the knitting machine. As the rollers rotate, the rubber yarn is pulled off of the spindles and any elongation of the rubber yarn occurs prior to the rubber yarn exiting the rollers. Therefore, the yarn or strand material exits the rollers in a relaxed or un-elongated state. The rollers, typically revolving in opposite directions, can be synchronized to rotate in timing with the corresponding rubber yarn consumption of the knitting mechanism. In one embodiment, the roller apparatus further comprises a range of lateral motion allowing the roller apparatus to synchronically travel with the knitting mechanism to either eliminate or minimize the amount of elongation introduced into the bare rubber in the knitting process during each pass.

Combinations of each of the above mentioned embodiments of the invention are also contemplated and are encompassed by the present invention. For example, in order to reduce or eliminate the elongation of the bare rubber during the knitting process, the tension settings on the feeding equipment can be adjusted in combination with the bare rubber being coated with Talcum powder, cornstarch or the like.

The following example is merely illustrative of the present invention and should not be considered as limiting the scope of the invention in any way as the example and other equivalents thereof will be apparent.

EXAMPLES

Example 1

The knit fabric of Example 1 is a weft knit fabric made on a 3-system flatbed 12 gauge computerized flatbed knitting machine (CMS 530 HP Multi-Gauge) made by Stoll (H. Stoll GmbH & Co. KG, Stollweg 1, 72760 Reutlingen, Germany). The knit fabric is constructed as a half gauge tubular knit structure joined together by a 1×1 rib knit structure that is knit inside of the tubular structure. The tubular knit structure is knit using a jersey knit stitch preferably made of bare rubber strands, although further alternate embodiments can be made from a combination of bare rubber strands and non-elastic yarns, such as polypropylene yarn(s) and the rib structure is formed using a tuck stitch made of non-elastic yarn, preferably spun polypropylene yarns. In this example, extruded, 38 gauge uncovered natural bare rubber strands, at least partially coated with an amount of industrial grade Talcum powder that is equal to or less that the weight of the bare rubber is used to make the jersey stitch on both the front side and the rear side of the knit structure and the tuck stitch made with the preferred non-elastic yarn holds the jersey stitch on the front side in place with respect to the jersey stitch on the back side. The uncovered bare rubber strands are ribbons that come in a sheet of ribbons that are scored so that they can be separated into individual strands or ribbons and then wound up onto cones for use during the knitting process. The scored sheets of bare rubber are at least partially coated with an amount of industrial grade Talcum powder equal to or less than the weight of the bare rubber and are purchased from Piedmont Stretch, Inc. (Winston Salem, N.C. 27103). The sheets of scored ribbons are separated and wound onto a plurality of cones or spools by Norbut Manufacturing (Fall River, Mass. 02721). The non-elastic yarn used for the tuck stitch in this example is spun polypropylene yarn, preferably 200 denier polypropylene yarns purchased from Hickory Throwing (Hickory, N.C.).

During the knitting process non-elastic yarn will be fed to the knitting machine as is standard in the industry, but the uncovered, partially coated strands of bare rubber will preferably be fed to the knitting machine with a plurality of Memminger IRO (MI) MSF feeders, preferably one for each feed, in conjunction with one or two MI EFS 920 feeders, and electrical accessories that are standard in the industry. The feeders are available from MEMMINGER-IRO GmbH (MEMMINGER-IRO GmbH; Jakob-Mutz-Straβe 7; 72280 Dornstetten, Germany).

The knit fabric made in accordance with this example is shown in FIG. 1 and shown schematically in FIGS. 2-4. A technical diagram of the per pass stitch development of the fabric in the 3-system knitting machine is schematically shown in FIGS. 5A-5D. A technical diagram of a per pass stitch development of such a fabric in the single knitting function system knitting machine is schematically shown in FIGS. 6A-6F.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A knit fabric having a knit structure, the knit fabric comprising:

a first layer of jersey knit fabric and a second layer of jersey knit fabric, each of which include a series of vertical columns of jersey stitch loops; wherein the first and second layers of jersey knit fabric are joined to each other by a non-elastic yarn which alternately loops around vertical columns of jersey stitch loops in the first layer and jersey stitch loops in the second layer; wherein strands of bare rubber are used in the knit structure selected from the group consisting of the first layer of jersey knit fabric and the second layer of jersey knit fabric.

2. The knit fabric of claim 1, wherein the non-elastic yarn is polypropylene yarn.

3. The knit fabric of claim 1, wherein the fabric is formed on a flatbed knitting machine having a front needle bed and back needle bed and the fabric is formed by a method comprising:

a) forming one or more vertical columns of jersey knit stitch on both the front and back beds of the knitting machine, wherein the number of vertical columns of jersey knit stitch formed is the same on both the front and back beds;

b) forming one or more rows of tuck stitches connecting the vertical columns of jersey knit stitches formed on the front and back beds in step a); and c) repeating steps a) and b) until the knit fabric is of the desired size.

4. The knit fabric of claim 3, wherein the number of vertical columns of jersey knit stitch formed in step a) is two on the front bed and two on the back bed, and the number of rows of tuck stitches formed in step b) is selected from the group consisting of one and two.

5. The knit fabric of claim 1, wherein the knit fabric is formed on a flatbed knitting machine comprising a front needle bad and back needle bed and the knit fabric is formed by a method comprising:

i) forming a single row of tuck stitches across both beds;

ii) forming a single vertical column of jersey knit stitch on the front bed and a single vertical column of jersey knit stitch on the back bed;

iii) forming a single row of tuck stitches across both beds;

iv) forming a single vertical column of jersey knit stitch on the front bed and a single vertical column of jersey knit stitch on the back bed; and v) repeating steps i) through iv) until the knit fabric is of a desired size.

6. The knit fabric of claim 1, wherein the jersey stitch on both the front bed and the back bed is made at least in part from uncovered strands of bare rubber that are at least partially coated with an agent selected from the group consisting of moisture absorbing powders and silicone containing lubricating agents.

7. The knit fabric of claim 6, wherein the tuck stitches are formed on every other needle to form a 1×1 rib structure.

8. The knit fabric of claim 1, wherein the first and second jersey knit layers are formed as a half gauge tubular knit structure.

9. A knit fabric having a knit structure including a front side and a back side, the knit fabric comprising:

a first tuck stitch component, a second jersey stitch component and a third jersey stitch component; wherein the second jersey stitch component is located on the front side and includes at least one continuous strand of bare rubber and a plurality of continuous strands selected from the group consisting of continuous strands of bare rubber and continuous strands of non-elastic yarn, knit together into a jersey stitch layer residing on the front side; and wherein the third jersey stitch component is located on the back side and includes a plurality of continuous strands selected from the group consisting of continuous strands of bare rubber and continuous strands of non-elastic yarn, knit together into a jersey stitch layer residing on the back side; wherein the first tuck stitch component includes a plurality of continuous strands selected from the group consisting of continuous strands of bare rubber and continuous strands of non-elastic yarn, knit together into a tuck stitch pattern that engages a plurality of continuous strands of the second jersey stitch component and a plurality of continuous strands of the third jersey stitch component so as to hold the second and third jersey stitch components together.

10. The knit fabric of claim 9, wherein the non-elastic yarn is polypropylene yarn.

11. The knit fabric of claim 9, wherein the knit fabric is formed on a flatbed knitting machine having a front needle bed and back needle bed and the knit fabric is formed by a method comprising:

a) forming one or more vertical columns of jersey knit stitch on both the front and back beds of the knitting machine, wherein the number of vertical columns of jersey knit stitch formed is the same on both the front and back beds;

b) forming one or more rows of tuck stitches connecting the vertical columns of jersey knit stitches formed on the front and back beds in step a); and c) repeating steps a) and b) until the knit fabric is of a desired size.

12. The fabric of claim 11, wherein the number of vertical columns of jersey knit stitch formed in step a) is two on the front bed and two on the back bed, and the number of rows of tuck stitches formed in step b) is selected from the group consisting of one and two.

13. The knit fabric of claim 9, wherein the fabric is formed on a flatbed knitting machine comprising a front needle bed and back needle bed and the fabric is formed by a method comprising:

i) forming a single row of tuck stitches across both beds;

ii) forming a single vertical column of jersey knit stitch on the front bed and a single vertical column of jersey knit stitch on the back bed;

iii) forming a single row of tuck stitches across both beds;

iv) forming a single vertical column of jersey knit stitch on the front bed and a single vertical column of jersey knit stitch on the back bed; and v) repeating steps i) through iv) until the knit fabric is of a desired size.

14. The knit fabric of claim 9, wherein the jersey stitch layer on both the front bed and the back bed is made at least in part from uncover strands of bare rubber that are at least partially coated with an agent selected from the group consisting of moisture absorbing powders and silicone containing lubricating agents.

15. The knit fabric of claim 13, wherein the tuck stitches are formed on every other needle to form a 1×1 rib structure.

16. The knit fabric of claim 9, wherein the first and second jersey knit layers are formed as a half gauge tubular knit structure.

17. A method of forming a knit fabric on a double bed flatbed knitting machine having a front needle bed and a back needle bed; the method comprising the steps of:

a) forming one or more vertical columns of jersey knit stitch on both the front and back needle beds of the knitting machine, wherein the number of vertical columns of jersey knit stitch formed is the same on both the front and back needle beds;

b) forming one or more rows of tuck stitches connecting the vertical columns of jersey knit stitches formed on the front and back beds in step a); and c) repeating steps a) and b) until the knit fabric is of a desired size; wherein the fabric includes non-elastic yarn and strands of bare rubber.

18. The method of claim 17, wherein the number of vertical columns of jersey knit stitch formed in step a) is two on the front bed and two on the back bed, and the number of rows of tuck stitches formed in step b) is one or two.

19. The method of claim 17, wherein the method comprises:

i) forming a single vertical column of tuck stitches across both beds;

ii) forming a single vertical column of jersey knit stitch on the front bed and a single vertical column of jersey knit stitch on the back bed;

iii) forming a single row of tuck stitches across both beds;

iv) forming a single vertical column of jersey knit stitch on the front bed and a single vertical column of jersey knit stitch on the back bed; and v) repeating steps i) through iv) until the knit fabric is of a desired size; wherein the knit fabric includes non-elastic yarn and strands of bare rubber.

20. The method of claim 17, wherein the tuck stitches are formed on every other needle to form a 1×1 rib structure and wherein the jersey knit stitches are formed on every other needle to form a half gauge tubular knit structure.

21. The method of claim 17, wherein the jersey knit stitches are formed from uncovered strands of bare rubber and the tuck stitches are formed from non-elastic yarn.

22. The method of claim 17, wherein the uncovered strands of bare rubber used to make the jersey stitch are at least partially coated with a coating material to temporarily reduce or eliminate the degree to which the uncovered bare rubber catches on elements of the knitting machine so as to reduce elongation of the uncovered strands of bare rubber during the incorporation of the bare rubber into the fabric; wherein the coating material is an agent selected from the group consisting of moisture absorbing powders and silicone containing lubricating agents.

23. A knit fabric having a knit structure, the knit fabric comprising:

a front side and a back side; the front side including a first jersey stitch component and the back side including a second jersey stitch component; wherein the first jersey stitch component is located on the front side and includes at least one continuous strand of bare rubber and a plurality of continuous strands selected from the group consisting of continuous strands of bare rubber and continuous strands of non-elastic yarn, knit together into a jersey stitch pattern residing on the front side; and the second jersey stitch component is located on the back side and includes a plurality of continuous strands selected from the group consisting of continuous strands of bare rubber and continuous strands of non-elastic yarn, knit together into a jersey stitch pattern residing on the back side; wherein the knit fabric further includes a first tuck stitch component including a plurality of continuous strands selected from the group consisting of continuous strands of bare rubber and continuous strands of non-elastic yarn, knit together into a tuck stitch pattern that engages a plurality of continuous strands of the first jersey stitch component and a plurality of continuous strands of the second jersey stitch component so as to hold the first and second jersey stitch components together.

24. The knit fabric of claim 23, wherein the non-elastic yarn is polypropylene yarn.

25. The knit fabric of claim 23, wherein the jersey stitch on both the front bed and the back bed is made at least in part from uncover strands of bare rubber that are at least partially coated with an agent selected from the group consisting of moisture absorbing powders and silicone containing lubricating agents.

* * * * *